US005413505A

United States Patent [19]

Hayes et al.

[11] Patent Number: 5,413,505

[45] Date of Patent: May 9, 1995

[54] FUSED ELECTRICAL CONNECTORS

[75] Inventors: Brian B. Hayes, Melbourne, Australia; Colin J. Hayes, London, England

[73] Assignee: Multico International Pty., Limited, Melbourne, Australia

[21] Appl. No.: 142,302

[22] PCT Filed: Jun. 10, 1992

[86] PCT No.: PCT/GB92/01042

§ 371 Date: Nov. 23, 1993

§ 102(e) Date: Nov. 23, 1993

[87] PCT Pub. No.: WO92/22945

PCT Pub. Date: Dec. 23, 1992

[30] Foreign Application Priority Data

Jun. 11, 1991 [GB] United Kingdom ..... 9112513
Nov. 7, 1991 [GB] United Kingdom ..... 9123632
Nov. 20, 1991 [GB] United Kingdom ..... 9124603

[51] Int. Cl.[6] ..... H01R 13/68; H01R 33/26

[52] U.S. Cl. ..... 439/622; 337/187

[58] Field of Search ..... 439/621, 622; 337/187, 337/193, 198, 208, 210

[56] References Cited

U.S. PATENT DOCUMENTS 2,558,581 6/1951 Powell et al. ..... 439/621
4,768,978 9/1988 Wettengel et al. ..... 439/621
5,034,846 7/1991 Hodge et al. ..... 439/622 X

*Primary Examiner*—Eugene F. Desmond
*Attorney, Agent, or Firm*—Richard Litman

[57] ABSTRACT

An electrical connector, such as a domestic supply plug, utilizes a cartridge fuse (60) clamped within a receptacle or cage comprising two parts (61, 62) which snap engage together in a permanent fashion. The cage part (61 or 62) or both have spline or key formations (63) on an outer surface while the plug body (64) has a cavity (65) extending from an outer surface and includes channels or keyways (66) complementary to the spline or key (63) on the cage. The fuse and cage assembly may thus be pressed into the body of the plug with the spline forming the key such that only the correct fuse assembly may fit the chosen plug.

5 Claims, 4 Drawing Sheets

FUSED ELECTRICAL CONNECTORS

Figure 1:
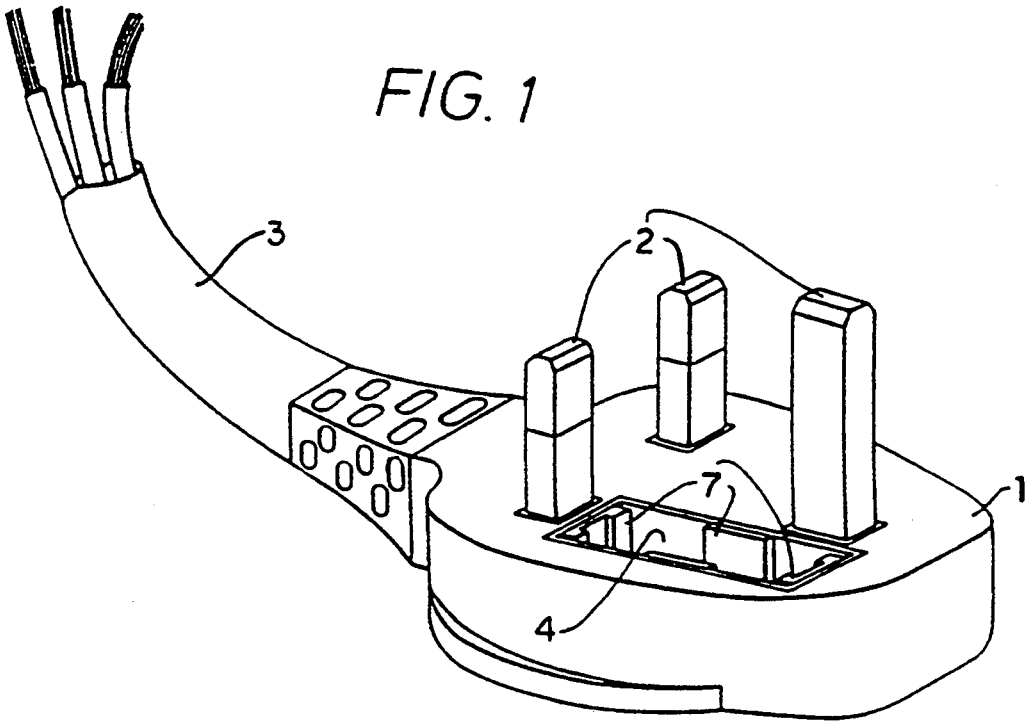

This invention relates to fused electrical connectors and is particularly, but not essentially, concerned with fused electrical plugs or sockets.

Ideally, electrical appliances should be fitted with a fuse having a rating which is matched to the current consumption of the appliance. Appliances which are connected to the mains supply through a fly-lead include a plug assembly which is adapted to receive a cartridge fuse of an appropriate rating. Free plugs when supplied usually have fitted to them a fuse of the maximum allowable rating such as thirteen amp. It is common practice to provide appliances with a fly-lead including a moulded-on plug and in this case the manufacturer can fit a fuse to the plug of a suitable rating for the current consumption of the appliance. Nevertheless, if the fuse has to be changed, it is quite likely that the wrong rating will be fitted.

Broadly, and in accordance with this invention, there is provided a fused electrical connector wherein the fuse or a receptacle for the fuse has a keyed construction which is complementary to a keyed construction on the body of the connector whereby only a fuse or receptacle having the correct key can be fitted to any particular connector.

In one embodiment of this invention, the connector incorporates a cavity with side walls having formations defining keyways which are complementary to formations provided on a receptacle containing a fuse, the fuse receptacle being engageable with the cavity and the cavity further including electrical contact means which are bridged by the fuse.

The fuse may itself have a body with the appropriate keyways or more preferably the fuse may comprise a cartridge type fuse which is located within a receptacle provided on the outer surfaces with appropriate keyways to engage the cavity in the connector. With such an arrangement it is only possible for the correct rated fuse to be used with any particular connector and in an advantageous arrangement the receptacle comprises parts which fit around a cartridge fuse so as to permanently engage the fuse, preventing detachment.

In a second aspect of this invention there is provided a fly-lead and electrical connector assembly for use with an electrical appliance, the connector being permanently moulded onto the lead and in electrical connection with the conductors at an end of the lead, and further incorporating a fuse assembly as hereinbefore referred to. With this arrangement coded leads complete with plugs, for example, can be supplied to a manufacturer or electrical fitter for fitting to an appliance with the lead and plug having the correct rated fuse which may only be replaced by a fuse of similar rating by virtue of the complementary engagement of the relevant keyways between the plug body and fuse receptacle.

Such an arrangement firstly avoids the necessity for a consumer to fit his own plug to an appliance and secondly avoids the danger of a consumer inadvertently fitting the incorrect rated fuse as a replacement.

As will be understood, each different rating of fuse has a unique configuration of formations forming the keyways which only co-operate with the unique complementary formations provided on the connector body.

This invention and further preferred features thereof are more fully described with reference to the accompanying drawings which show a moulded plug assembly for an appliance with an integral fuse.

Figure 2:
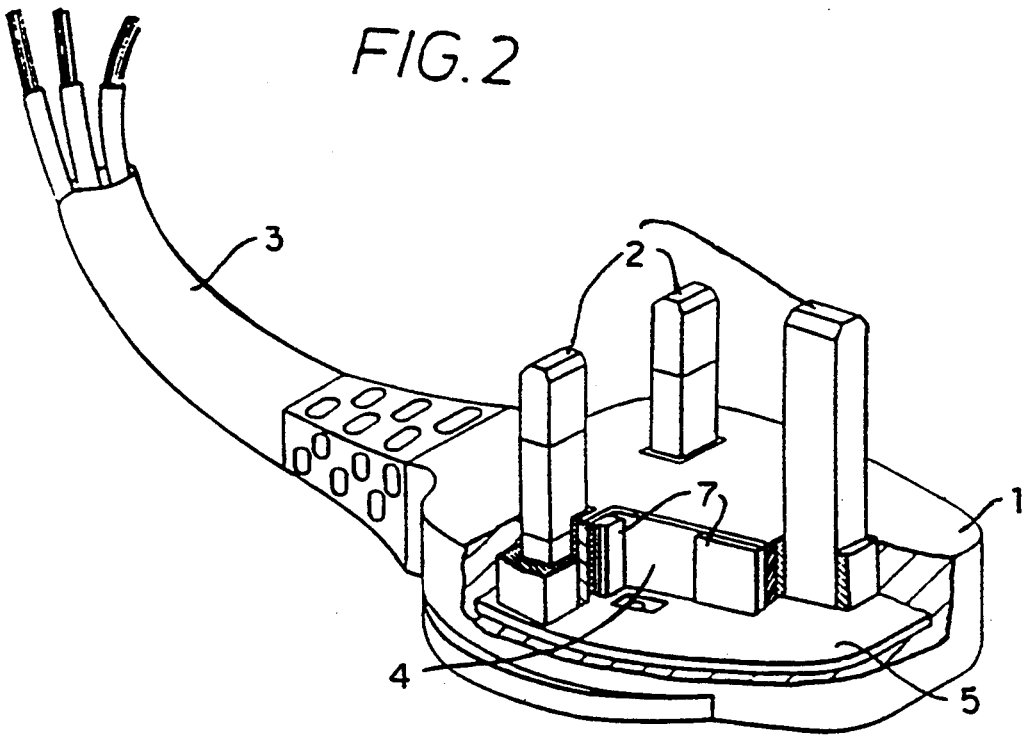
Figure 3:
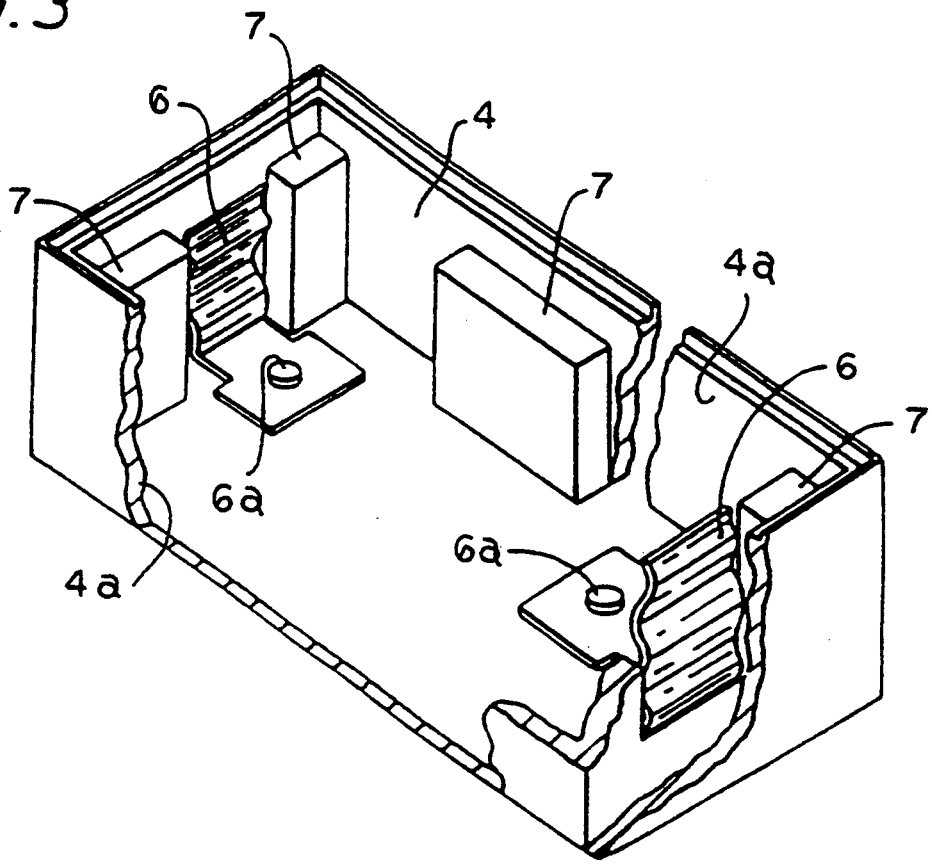
Figure 5:
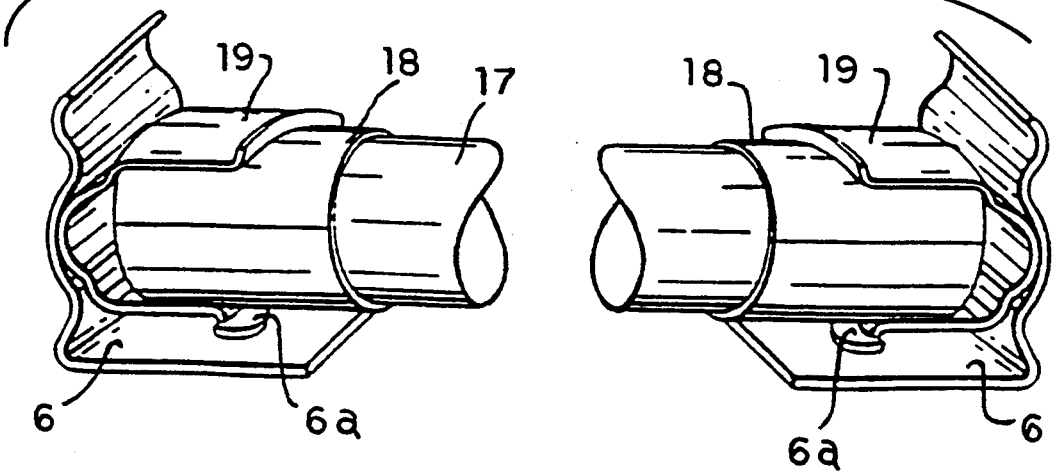
Figure 4:
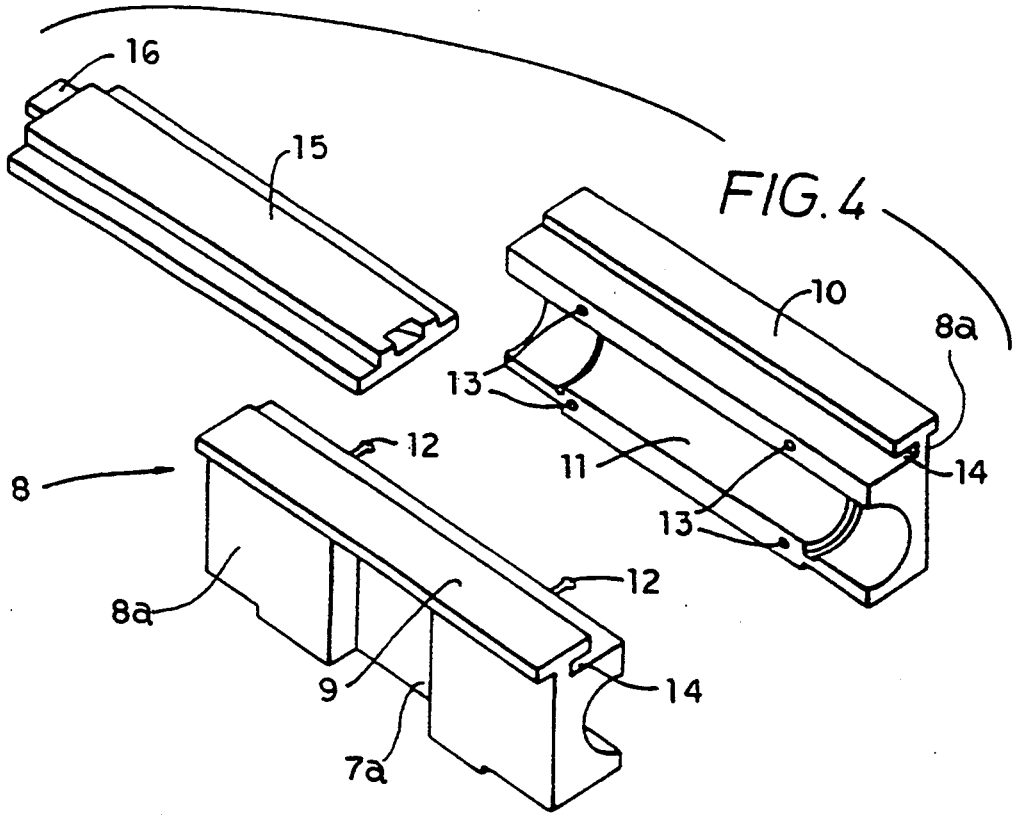
Figure 6:
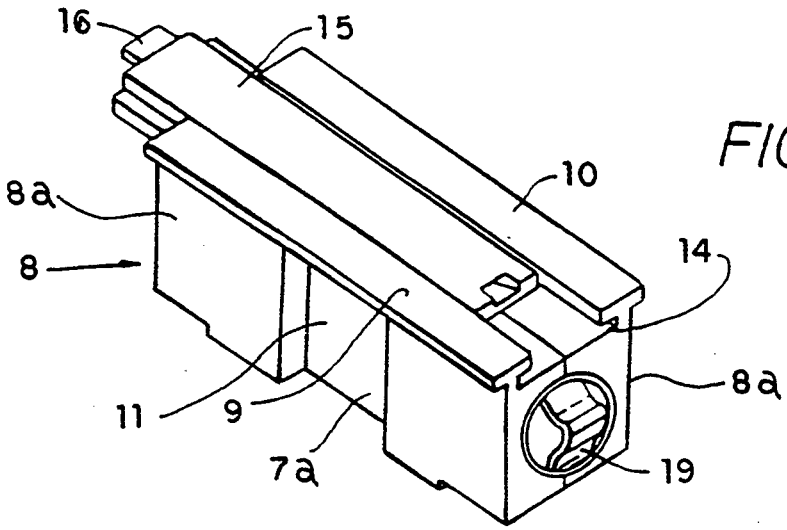
Figure 7:
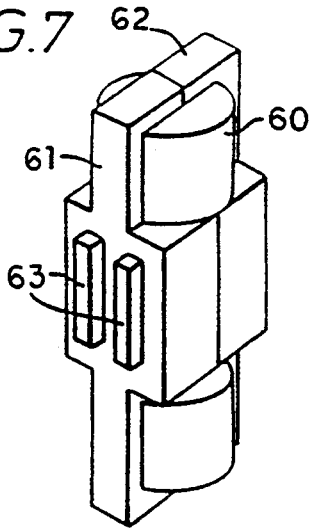
Figure 8:
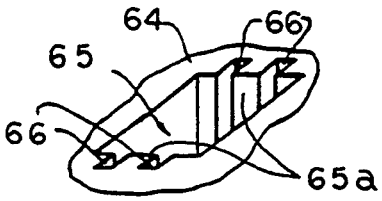
Figure 9:
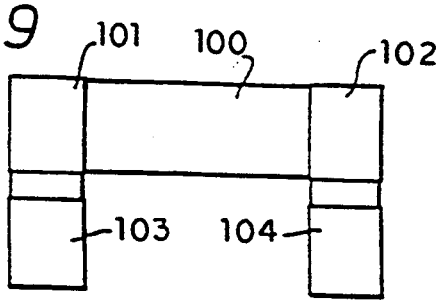
Figure 10:
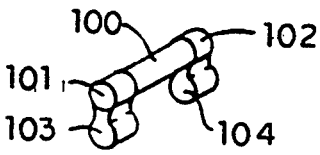

Referring to the drawings:

FIG. 1 shows a perspective view of a plug moulded to the end of a fly-lead for connection with an appliance, FIG. 2 shows a partially cutaway view of the plug of FIG. 1, FIG. 3 shows a detail of the cavity for receiving the fuse, FIG. 4 shows an exploded view of the fuse receptacle which engages the cavity of FIG. 3, FIG. 5 shows the cartridge fuse carrier contacts, FIG. 6 shows the fuse receptacle assembled, FIGS. 7 and 8 show a further keyed fuse, and FIGS. 9 to 12 show yet a further key fuse arrangement.

Referring to the drawings, FIG. 1 shows a British Standard three pin thirteen amp plug having a body 1 with electrical contact pins 2. The body 1 is integrally moulded on to a fly-lead 3, which is for connection with an appliance. The electrical conductors within the lead 3 are connected with the appropriate pins internally before the plug body is moulded on to the end of the lead. The body is provided with a cavity 4 formed by a plurality of sidewalls 4*a* and which is adapted to receive a fuse assembly. As shown in FIG. 2, the pins 2 and cavity 4 are carried on a base plate 5 to which the appropriate electrical connections are made with the base plate being thereafter integrally moulded together with the body 1 by an injection moulding process, for example.

As shown in FIG. 3, the plug body cavity 4 comprises a rectangular unit having connectors 6 at each end and with moulded formations 7 forming keyways. The cavity 4 is adapted to receive a fuse receptacle 8 which is shown in exploded view in FIG. 4 and includes sidewalls 8*a*. The receptacle comprises two body parts 9 and 10 which define a cylindrical cavity 11 serving to receive a standard size cartridge fuse (not shown here). The two body parts 9 and 10 may be brought together and secured by means of inter-engaging spigots 12 and recesses 13 of which four are provided in the example shown. The spigots have suitable formations such that after engagement in the recesses 13 the parts cannot be easily separated and thus a cartridge fuse within the cavity 11 is secure against replacement. The top of the receptacle may include slideways 14 which receive a latching tongue 15 having a lug 16 to engage a suitable recess in the body of the plug 1.

The cartridge fuse and contact assembly is shown in FIG. 5 and this comprises a standard cylindrical cartridge fuse 17 having conductive end caps 18 which are received in conductive clips 19, this assembly fitting within the fuse receptacle cavity 11 formed between the two receptacle body parts 9 and 10 such that the conductive clips 19 protrude from each open end thereof as illustrated in FIG. 6. The clips 19 are designed to engage the clips 6 provided in the cavity 4 which clips are retained by suitable rivets 6*a*.

The fuse receptacle as shown in FIGS. 4 and 6, includes formations 7*a* which are complementary to the formations 7 in the cavity 4 and thus only one unique fuse receptacle will fit any particular cavity 4 provided within the plug body 1. The fuse receptacle 8 is retained by means of the sliding tongue 15 which has the lug 16 which may be moved into the recess in the plug body to retain the assembly.

With a construction generally in accordance with this invention, the plug body 1 may be provided with one of a number of combinations of different keyways or formations 7, each of which can receive only one particular receptacle 8 containing the correct rated fuse for that appliance. A further feature of this invention is the arrangement of the connectors or contacts 6 within the cavity 4 which are configured to prevent a standard cartridge fuse being successfully inserted.

In a modified construction the sliding tongue 15 on the fuse receptacle 8 may be omitted and the receptacle held in the body cavity 4 by means of engaging detents or the like retaining means.

Where the connector is formed from a nylon or polyamide material and includes a flame retardant then the housing can be moulded directly onto the pin carrying base of the plug. With such a hard material the keyways 7 can be moulded directly into the connector body and have good wear resistance properties. An internal plate could be used to position the pins if required.

If a softer material such as PVC were to be used then, for safety reasons, the terminals would need to be covered with a heat resistant or flame retardant and this could be achieved by a plate member and a cover. The softer material would require the fuse receptacle and the cavity in the connector body to be of a hard material to provide a good service life for the keyways 7.

Both the above constructions are within the scope of this invention.

FIGS. 7 and 8 show a modification according to this invention, wherein the cartridge fuse 60 is clamped within a receptacle or cage comprising two parts 61, 62 which snap engage together. The cage part 61 or 62 or both have spline formations 63 on an outer surface.

The plug body 64 has a cavity 65 extending from an outer surface and including on sidewalls 65*a*, channels 66 complementary to the spline 63 on the cage. The fuse and cage assembly may thus be pressed into the body of the plug with the spline forming the key such that only the correct fuse assembly may fit the chosen plug.

The aperture or cavity 65 in the plug body may be moulded directly into the plug or may comprise a separate carrier which is inserted into the plug body after manufacture to adapt same to a particular fuse rating.

Figure 11:
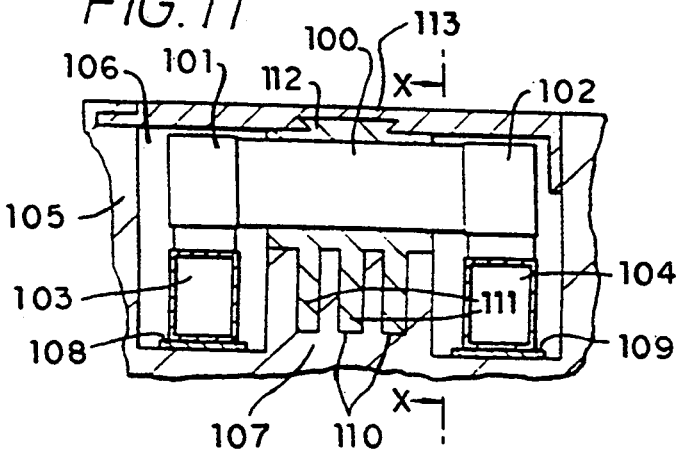
Figure 12:
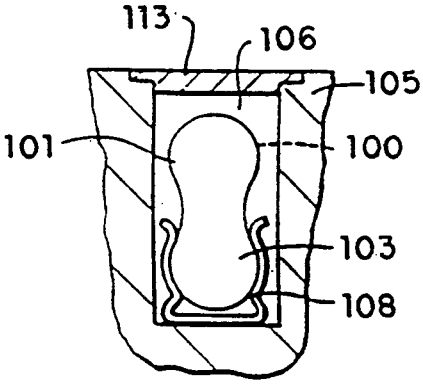

FIGS. 9, 10, 11 and 12 show yet a further arrangement primarily intended to prevent a standard cartridge fuse being fitted and having the advantageous feature of providing also a keyed fuse assembly. As shown a cartridge fuse 100, which may be a standard unit, is secured in end caps 101, 102 which include cylindrical connectors 103, 104. The body of the plug 105 has a recess 106 with a central block 107 each side of which includes spring clips 108, 109. The fuse 100, alone, cannot be pressed into electrical contact with both clips 108, 109 simultaneously; this may only be achieved through the caps 101, 102 and integral connectors 103, 104 as shown in FIGS. 11 and 12.

A further feature of this construction is the provision of recesses 110 in block 107 which match fingers 111 on a cylindrical key 112 around fuse 100. The key 112 may engage with sliding closure 113 providing an integral assembly. Only the fuse having a correct key may be used in any given plug.

We claim:

1. A fused electrical connector comprising;

a body provided with a cavity defined by a plurality of sidewalls, key/keyway formations on at least one said cavity sidewall, spaced apart electrical contacts affixed within said body cavity, a fuse receptacle including a plurality of substantially permanently assembled parts having an interior cavity and providing a plurality of sidewalls, a cartridge fuse having endmost electrical conductors and non-detachably mounted within said interior cavity of said substantially permanently assembled receptacle parts with said endmost electrical conductors exposed to the exterior of said fuse receptacle, key/keyway formations on at least one said receptacle sidewall complementary to said key/keyway formations on said at least one said body cavity sidewall, and said receptacle with said fuse therein insertable within said connector body cavity in a single straight line motion with said complementary key/keyway formations on said fuse receptacle and body cavity permitting of said insertion, whereby cartridge fuses of a similar external dimension but of varying ratings are non-detachably mounted within a single size of said fuse receptacle while said complementary key/keyway formations on said cavity and fuse receptacle sidewalls are specific for each rating of any one said fuse, thereby precluding insertion of any one said fuse receptacle having an improperly rated fuse for a particular electrical connector.

2. A fused electrical connector according to claim 1 wherein, said body cavity sidewall key/keyway formations are disposed between said spaced apart electrical contacts, whereby upon insertion of one said fuse receptacle into said body cavity, said fuse endmost electrical conductors bridge said electrical contacts within said body cavity.

3. A fused electrical connector according to claim 1 including, latch means securing said fuse receptacle within said connector body cavity.

4. A fused electrical connector according to claim 1 wherein, said key/keyway formations comprise channels and recesses forming splines.

5. A fused electrical connector according to claim 1 including, a fly-lead joined to said connector body, and a common identification means applied to said fly-lead, connector body and fuse.

* * * * *